US009388956B2

(12) United States Patent
Takahashi et al.

(10) Patent No.: US 9,388,956 B2
(45) Date of Patent: Jul. 12, 2016

(54) LIGHTING DEVICE

(71) Applicant: KABUSHIKI KAISHA TOSHIBA, Minato-ku (JP)

(72) Inventors: Ken Takahashi, Kumagaya (JP); Osamu Ono, Fukaya (JP); Shusuke Morita, Fukaya (JP); Masahiro Yokota, Fukaya (JP); Nobuo Kawamura, Kumagaya (JP); Takeshi Ookawa, Kumagaya (JP); Hidemi Matsuda, Toda (JP); Hideo Oota, Tokyo (JP); Takashi Nishimura, Fukaya (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 280 days.

(21) Appl. No.: 14/104,533

(22) Filed: Dec. 12, 2013

(65) Prior Publication Data

US 2014/0098546 A1 Apr. 10, 2014

Related U.S. Application Data

(63) Continuation of application No. PCT/JP2012/066661, filed on Jun. 29, 2012.

(30) Foreign Application Priority Data

Jul. 15, 2011 (JP) ..... 2011-157207
May 30, 2012 (JP) ..... 2012-123768

(51) Int. Cl.
*F21V 5/00* (2015.01)
*F21V 11/00* (2015.01)
(Continued)

(52) U.S. Cl.
CPC . *F21V 5/00* (2013.01); *F21V 11/00* (2013.01); *F21S 8/02* (2013.01); *F21V 3/04* (2013.01)

(58) Field of Classification Search
CPC ..... F21V 5/00; F21V 11/00; F21V 3/04; F21S 8/02
USPC ..... 362/330, 333, 326, 311.01
See application file for complete search history.

(56) References Cited

U.S. PATENT DOCUMENTS 1,585,873 A * 5/1926 Pougher ..... F21V 5/00 359/831
7,748,148 B2 * 7/2010 Reiland ..... G02B 6/005 362/311.01

(Continued)

FOREIGN PATENT DOCUMENTS

JP 3-167707 A 7/1991
JP 2002-197592 A 7/2002

(Continued)

OTHER PUBLICATIONS

International Search Report mailed Sep. 25, 2012 for PCT/JP2012/066661 filed on Jun. 29, 2012 with English Translation.

(Continued)

*Primary Examiner* — Laura Tso
(74) *Attorney, Agent, or Firm* — Oblon, McClelland, Maier & Neustadt, L.L.P.

(57) ABSTRACT

According to one embodiment, a lighting device includes a light source, and at least one light distribution control member configured to control distribution of light from the light source. The light distribution control member includes a base member higher in refractive index than air, and two optical control layers located opposite each other with a predetermined space therebetween on either side of the base member. The two optical control layers each includes a first region and a second region formed in correlative patterns. The light distribution control member is configured to control the light distribution based on a change of an overlap between the first and second regions depending on a direction of transmitted light.

17 Claims, 15 Drawing Sheets

(51) Int. Cl.
*F21S 8/02* (2006.01)
*F21V 3/04* (2006.01)

(56) References Cited

U.S. PATENT DOCUMENTS

| | | | | |
|---|---|---|---|---|
| 8,345,183 | B2 * | 1/2013 | Bae | B82Y 20/00 349/31 |
| 2002/0018349 | A1 * | 2/2002 | Aikawa | B60Q 1/2607 362/520 |
| 2009/0021935 | A1 * | 1/2009 | Lin | G02B 5/0242 362/246 |
| 2010/0066946 | A1 | 3/2010 | Song et al. | |

FOREIGN PATENT DOCUMENTS

| | | | |
|---|---|---|---|
| JP | 2002-297592 | A | 10/2002 |
| JP | 2006-120499 | A | 5/2006 |
| JP | 2007-334298 | A | 12/2007 |
| JP | 2008-197652 | A | 8/2008 |
| JP | 2010-073685 | A | 4/2010 |

OTHER PUBLICATIONS

International Written Opinion mailed Sep. 25, 2012 for PCT/JP2012/066661 filed on Jun. 29, 2012.

* cited by examiner

No light distribution control member

Light distribution control member used

LIGHTING DEVICE

CROSS-REFERENCE TO RELATED APPLICATIONS

This application is a Continuation Application of PCT Application No. PCT/JP2012/066661, filed Jun. 29, 2012 and based upon and claiming the benefit of priority from Japanese Patent Applications No. 2011-157207, filed Jul. 15, 2011; and No. 2012-123768, filed May 30, 2012, the entire contents of all of which are incorporated herein by reference.

FIELD

Embodiments described herein relate generally to a lighting device comprising a light distribution control member.

BACKGROUND

A lighting fixture for use as a lighting device or luminaire to be installed on, for example, a ceiling generally comprises a plurality of reflective plates arranged perpendicular to the ceiling and uses a technique to intercept unnecessary dazzling light obliquely emitted from the ceiling by means of the reflective plates.

In the lighting fixture using these reflective plates, however, cleaning of the reflective plates of a complicated shape takes time and entails higher manufacturing costs. Further, the light-extraction efficiency is reduced by light absorption by the reflective plates.

Furthermore, there are known methods in which a target light distribution is obtained by arranging a plurality of non-reflective plates with openings in the emission direction of a light source or lenses are arranged in the emission direction of a light source. In these cases, however, original properties cannot be obtained if the light source is misaligned with the non-reflective plates or lenses, so that fixing parts cannot be simplified.

DETAILED DESCRIPTION

Various embodiments will be described in detail with reference to drawings. In general, according to one embodiment, a lighting device comprises a light source; and at least one light distribution control member configured to control distribution of light from the light source. The light distribution control member comprises a base member higher in refractive index than air, and two optical control layers located opposite each other with a predetermined space therebetween on either side of the base member. The two optical control layers each comprising a first region and a second region formed in correlative patterns. The light distribution control member is configured to control the light distribution based on a change of an overlap between the first and second regions depending on a direction of transmitted light.

First Embodiment

Figure 1:
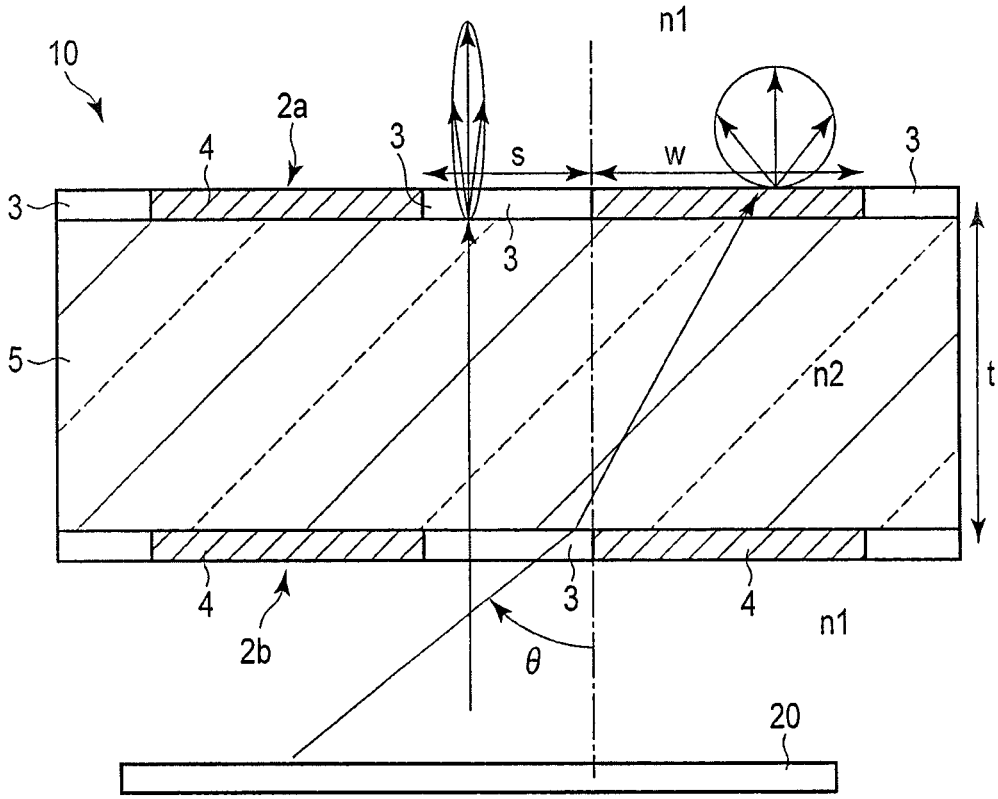
FIG. 1 is an enlarged sectional view showing an illumination light distribution control member in a lighting device according to a first embodiment.

FIG. 1 is an enlarged sectional view showing an illumination light distribution control member 10 used in a lighting device according to a first embodiment. The illumination light distribution control member 10 is provided in a light-emitting area of a light source 20 of the lighting device. The light source 20 represents a light source that emits light when supplied with electricity. In FIG. 1, the lower side of the illumination light distribution control member 10 corresponds to the light-source side of the lighting device, and the upper side to the outside of the lighting device.

The illumination light distribution control member 10 comprises a base member 5 higher in refractive index than air, for example, a plate-shaped base member 5 of 2-mm thickness t made of a transparent resin with a refractive index of 1.49, and two optical control layers 2*a* and 2*b* located opposite and parallel to each other with a predetermined space therebetween on either side of the base member 5.

The optical control layers 2*a* and 2*b* have such a structure that first regions 3 and second regions 4 with different optical properties are alternately arranged side by side. Optical control layers 2*a* and 2*b* need not always have the same optical properties. As shown in FIG. 1, each of the optical control layers 2*a* and 2*b* is configured, for example, so that a plurality of striped light-scattering films are periodically formed by printing on a surface of the base member 5. The first regions 3 of 1.42-mm width S as non-printed (opening) portions and the second regions 4 of 2-mm width W as printed (opening) portions are alternately arranged side by side in the transverse direction of the stripes.

The respective patterns of the two optical control layers 2*a* and 2*b* are in the same phase ($\Delta$=0 mm) and are configured so that the two patterns overlap each other, that is, the two first regions 3 overlap each other and the two second regions 4 overlap each other, when the illumination light distribution control member 10 is viewed in the normal direction.

If the light source 20 is, for example, a linear light source, the optical control layers 2*a* and 2*b* are disposed so that the striped first regions 3 and second regions 4 extend substantially perpendicular to the axis of the light source 20. The entire surface of the base member 5 is matted on the side of the optical control layer 2*a*, which is the light emitting side, and is kept flat by virtue of not being matted on the side of the optical control layer 2*b*, which is the light entering side. As indicated by arrows representative of light beams in the drawing, therefore, a light beam transmitted through the first region 3 of the optical control layer 2*b* travels without spreading, while a light beam transmitted through the first region 3 of the optical control layer 2*a* is somewhat scattered due to matting as it is emitted. This matting is intended to prevent the light source from being seen entire when the lighting device is directly viewed. Preferably, only the light emitting side should be matted in consideration of the function of an illumination light distribution control device, which will be described later. Further, matting means may comprise roughening the surface of the base member 5 during its formation, printing a matted layer on the entire surface of the base member 5, etc.

Now let us suppose light incident on the first regions 3 of the optical control layer 2*b*. Among light beams incident at an angle of incidence (vertical entry/exit angle) $\theta$ to the direction normal to the first regions 3 of the optical control layer 2*b*, as shown in FIG. 1, a light beam incident at an angle $\theta$ of zero has the largest number of components that are emitted to the outside after directly passing through the first regions 3 of the optical control layers 2*a* and 2*b*.

As indicated by an arrow in FIG. 1, a light beam incident at an angle of incidence $\theta$ in a predetermined oblique direction is applied to the second region 4 of the optical control layer 2*a*. If the second region 4*a* is based on a light-scattering film, most of the incident light is scattered and reflected. However, some of the light is transmitted and its light distribution is deflected into a cosine-distribution having a high luminous intensity in the direction normal to the optical control layers 2*a* and 2*b*. The light reflected by the second region 4 on the light emitting side is also caused to be incident again on the optical control layer 2*a* after repeated reflection. The light finally transmitted through and extracted from the optical control layer 2*a* is deflected into a cosine-distribution having a high luminous intensity in the normal direction.

Thus, light transmitted through the illumination light distribution control member 10 constructed in this manner is extremely weak when it is obliquely emitted at a vertical exit angle $\theta$ of about 90°, so that glare in this direction can be reduced. At the same time, the light directly transmitted through the first regions 3 of the optical control layers 2*a* and 2*b* is retained, so that an efficiency loss in the lighting device can be suppressed.

The base member 5 is suitably made of a material with a higher refractive index than any of the regions around the illumination light distribution control member 10 in which it is disposed, and glass or light-transmitting ceramics, as well as the transparent resin, may be used for the material. Further, the base member 5 may be mixed with some scattering fillers. The first regions 3 of the optical control layer 2*a* may be matted, in order to prevent the interior of the lighting device from being seen from the outside when directly viewed. Also in this case, the function of the present embodiment can be achieved only if there is a difference in optical properties between the first and second regions 3 and 4 of the optical control layer 2*a*.

The formation of the first and second regions 3 and 4 is not limited to printing, and they may alternatively be formed by PVD, CVD, photolithography, frosting on the base member, mold surface texturing in injection molding, etc. Further, the base member 5 and the first and second regions 3 and 4 need not necessarily be bonded together, and the first and second regions 3 and 4 formed on a sheet separate from the base member 5 may be aligned with and affixed to each other.

An optimum design range for the light distribution control member 10 according to the first embodiment will now be described with reference to FIGS. 2A, 2B, 2C, 3A and 3B.

Figure 2A:
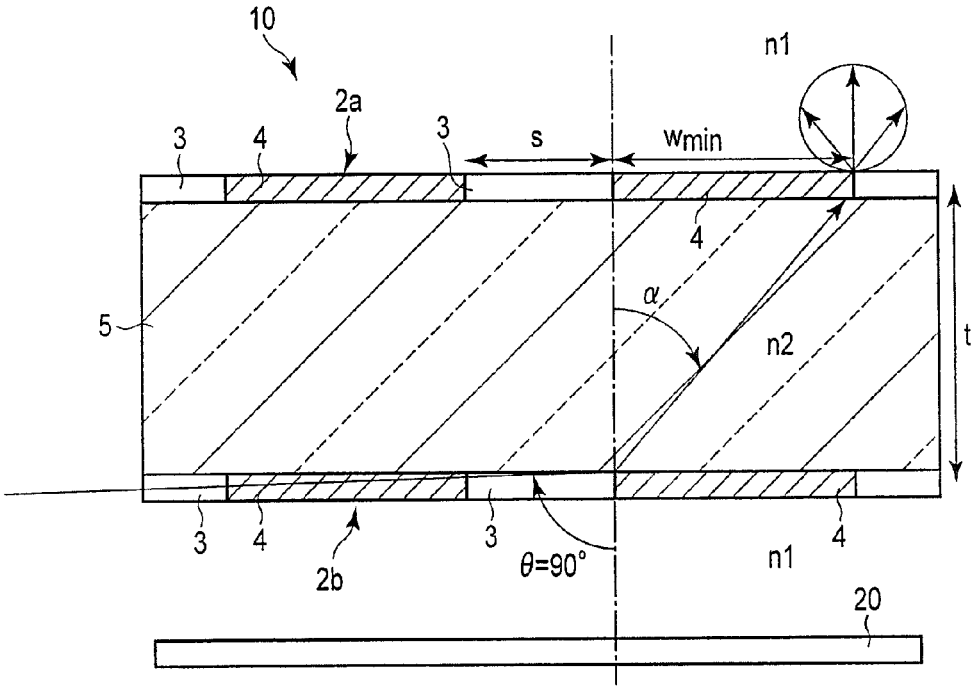
FIG. 2A is a view illustrating the minimum value of width W of second regions for keeping light from slipping through adjacent first regions in the first embodiment.

FIG. 2A is a view illustrating the minimum value of width W of the second regions 4 for keeping light from slipping through the adjacent first regions 3. This "slip-through" implies that the light passes directly through the first regions 3 of the optical control layers 2*a* and 2*b* without ever being incident on the second regions 4.

In view of the efficiency loss, it is advantageous to use smaller width W for the second regions 4. If width W is too small, however, some light inevitably slips through the second regions 4. Since the highly refractive base member 5 is provided between the two optical control layers 2*a* and 2*b*, however, width W of the second regions 4 for keeping light from slipping through the adjacent first regions 3 can take a finite value, as described later.

Let us suppose light incident on the right-hand ends of the first regions 3*b* of the lower-side optical control layer 2*b* at an angle θ of 90° at which light is most liable to slip through the regions. If the minimum width of the second regions 4 that prevents slip-through of the light is Wmin, an incident angle is α, indexes of refraction of air and the base member 5 are n1 and n2, thickness of the base member 5 is t, we obtain $$W\min = t \times \tan(\alpha) \quad (1)$$

$$\alpha = \arcsin(n1/n2) \quad (2)$$

as seen from the drawing. Thus, if width W of the second regions 4 is set to be greater than Wmin of equation (1), no light is allowed to slip through the adjacent first regions 3, so that all light is defined by the opposite first regions 3 or second regions 4 only. In the first embodiment, Wmin is about 1.9 mm, for example, and width W of the second regions 4 is designed to be 2.0 mm in consideration of a manufacturing tolerance.

Figure 2B:
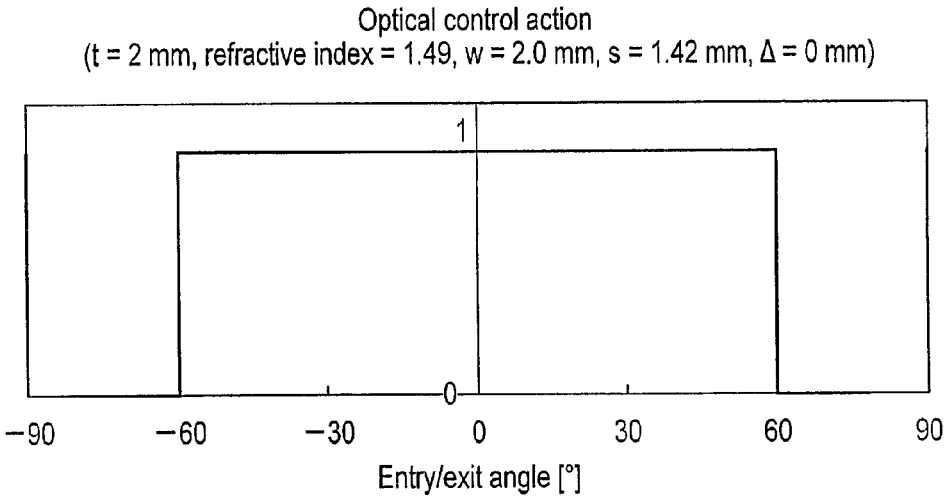
FIG. 2B is a diagram showing the relationship between the entry/exit angle of light passing through the light distribution control member and the presence/absence of an optical control action.

The abscissa of FIG. 2B represents the angle of incidence (vertical entry/exit angle) θ of a light beam to the direction normal to the light control member 10, and the ordinate represents the presence/absence of light that slips through the first regions 3 without ever being incident on the second regions 4 of the optical control layers 2*a* and 2*b* of the light distribution control member 10 (1 indicates the presence of light that slips through the first regions 1*a* without ever being incident on the second regions 4 of the optical control layers 2*a* and 2*b*, and 0 indicates that all light strikes the second regions 4 of the optical control layers 2*a* and 2*b*).

The first embodiment is designed so that some light slips through the first regions 3 of the optical control layers 2*a* and 2*b* of the light distribution control member 10 in the range of vertical angle of incidence θ of ±60° around the direction normal to the light distribution control member 10 and that all light strikes the second regions 4 at any other vertical angle of incidence θ. Thus, the light distribution control member 10 displays the function of strongly emitting light in the normal direction and suppressing light obliquely emitted at a vertical angle of incidence θ greater than 60° or less than −60°.

Figure 2C:
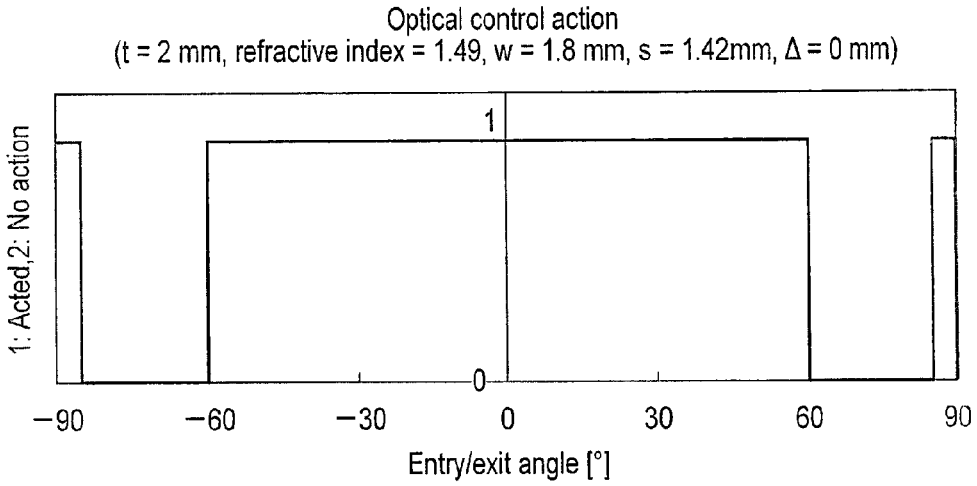
FIG. 2C is a diagram showing the entry/exit angle of light passing through the light distribution control member and the presence/absence of the optical control action in the case where width W is smaller than in the above condition.

FIG. 2C shows the presence/absence of light that slips through an optical control region for a vertical angle of incidence θ of the light control member 10 when width W of the second regions 4 is 1.8 mm in the first embodiment. As seen from this drawing, slip-through of light occurs near an angle of incidence of 90° with W=1.8 mm.

Thus, if the base member 5 has a refractive index higher than that of air, such a design can be achieved that light never slips through the second regions 4 with width W at a finite value. Conversely, there is no design configuration to completely prevent slip-through without the interposition of the highly refractive base member 5. In the configuration of the light distribution control member 10, therefore, the optical control layers 2*a* and 2*b* should preferably be provided on the opposite sides of the highly refractive base member 2.

The following is a description of a method of designing the region for optical control in the light distribution control member 10.

Figure 3A:
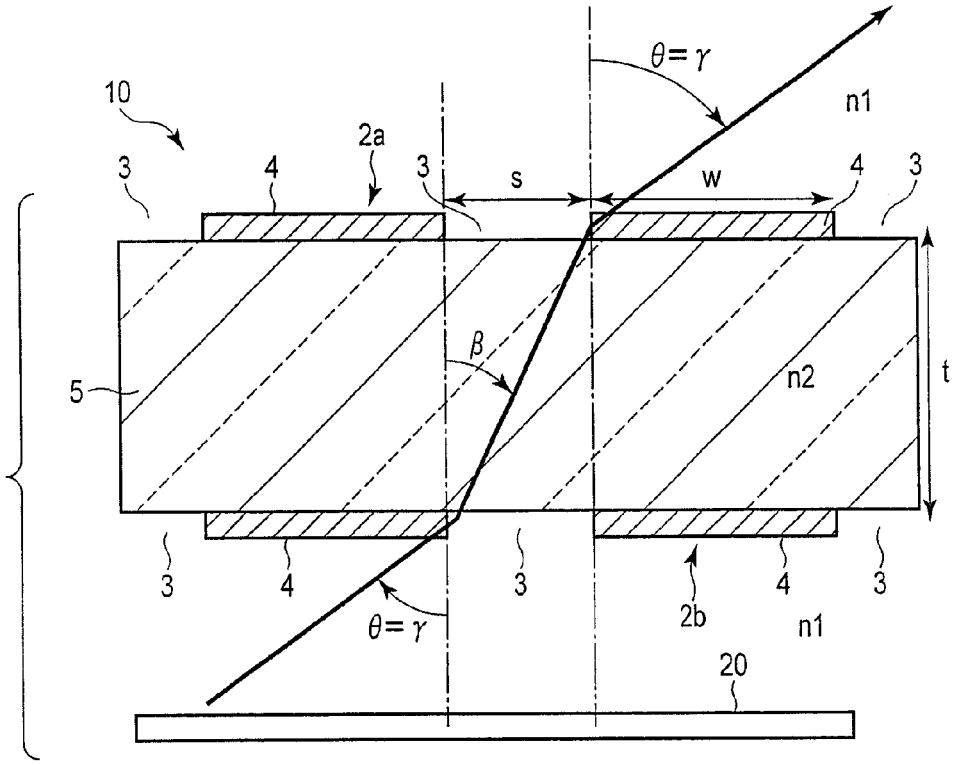
FIG. 3A is a view showing the maximum entry/exit angle at which the optical control action affects only light near the direction normal to the light distribution control member and the condition of width S of the first regions.

FIG. 3A shows width S of the first regions 3 that allows slip-through of light and the trajectory of a light beam obtained when the maximum vertical exit angle θ of the light that slips through the light distribution control member 10 is γ.

As seen from the drawing, the trajectory of light with vertical exit angle γ is inclined at angle β in the base member 5, and the two angles have a relationship given by equation (3) as follows:

$$\sin(\beta) = \{n1 \times \sin(\gamma)\}/n2 \quad (3)$$

Thus, width S should have a value given by equations (4) and (5) as follows:

$$S = t \times \tan(\beta) \quad (4)$$

$$B = \arcsin\{(n1/n2) \cdot \sin(\gamma)\} \quad (5)$$

Figure 3B:
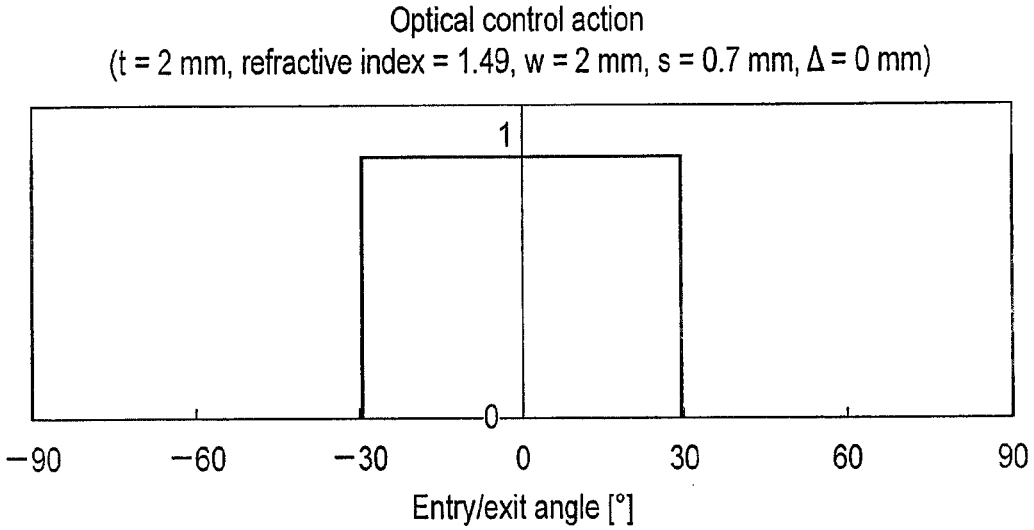
FIG. 3B is a diagram showing width S of the first regions, the entry/exit angle of light passing through the light distribution control member, and the presence/absence of the optical control action in the case where the maximum entry/exit angle at which the optical control action does not affect light is designed to be 30°.

In the first embodiment, such a design is provided that all light strikes the second regions 4 at a vertical exit angle of 60 to 90° with vertical exit angle γ set to 60°. FIG. 3B shows a design example with exit angle γ set within ±30°. In this case, width S should be set to 0.7 mm based on equations (4) and (5).

In the present embodiment, the first regions 3 or second regions 4 are striped. Although the light distribution control function of the light distribution control member 10 is displayed in the direction perpendicular to the stripes in this case, the light distribution control function based on an interference effect is not displayed in the direction parallel to the stripes. The light distribution control member 10 is used as a cover of the lighting device comprising a linear light source, such as a fluorescent lamp, and is disposed so that the longitudinal direction of the stripes is coincident with the direction perpendicular to the linear light source. Light can be shielded by, for example, the inner wall of an instrument that accommodates the light source. Thus, the same light shielding characteristics as those of a conventional baffle louver in which parallel plates are arranged can be obtained.

In the case where the light distribution control member 10 is used for a planar light source, not the linear one, or where light sources are discretely dispersed throughout the area of the backside, light cannot be shielded by the inner wall of an instrument that accommodates the light sources, so that transverse light shielding should also be performed on the side of the light distribution control member 10. Conventionally, light is shielded by a louver in the form of a lattice plate in which parallel plates are also disposed transversely. In the illumination light distribution control member 10 according to the present embodiment, as shown in FIGS. 4B to 4E, the patterns of the first and second regions 3 and 4 of the optical control layers 2*a* and 2*b* are controlled. Specifically, striped patterns may be set in dots.

Figure 4A:
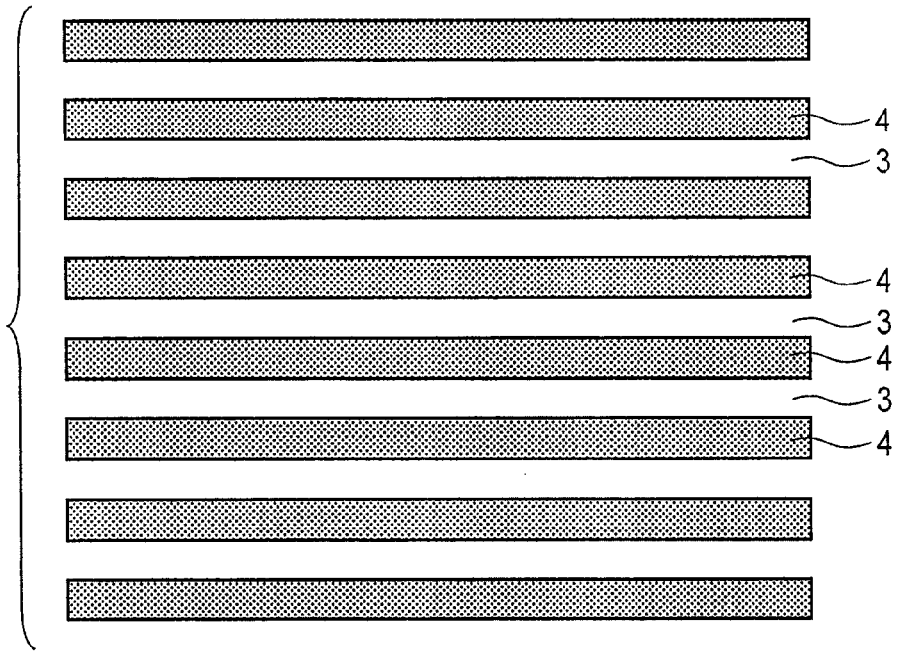
FIG. 4A is a plan view showing a pattern for the case where patterns of the first regions 3 and second regions 4 of optical control layers of the light distribution control member are designed for light shielding in a single direction.
Figure 4B:
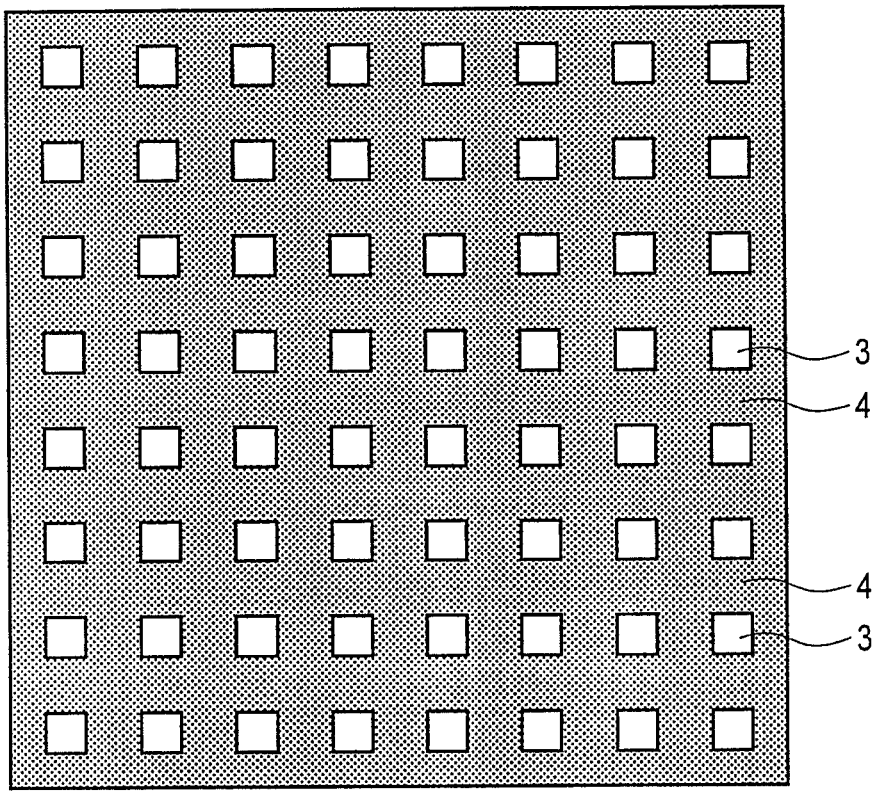
FIG. 4B is a plan view showing a pattern for the case where patterns of the first regions 3 and second regions of the optical control layers are designed for light shielding in two vertical directions.
Figure 4C:
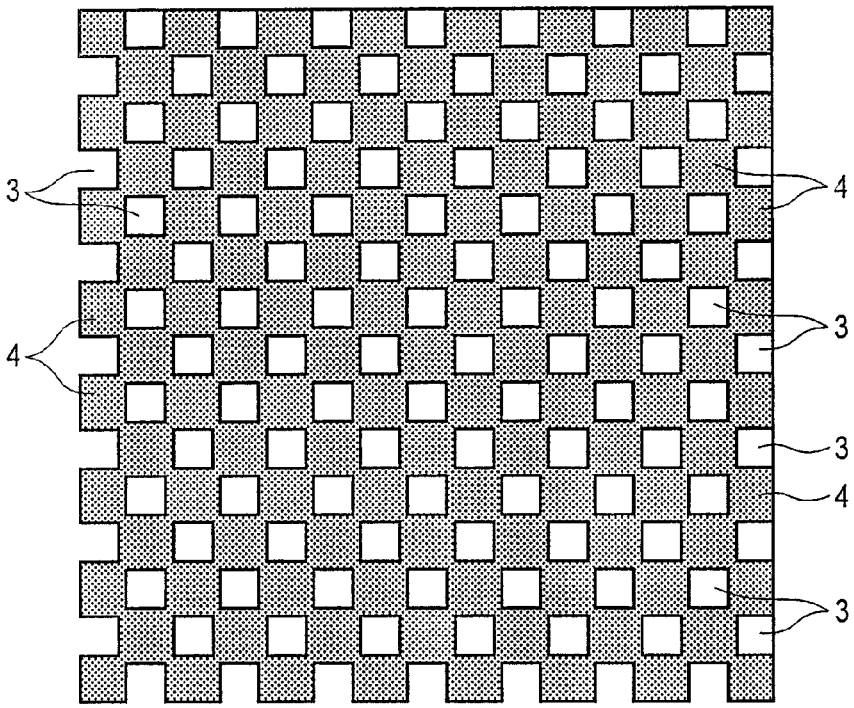
FIG. 4C is a plan view showing a pattern for the case where patterns of the first regions and second regions of the optical control layers are designed for light shielding in two vertical directions.

FIGS. 4B and 4C show pattern examples that display light shielding properties in two directions, a transverse (X-axis) direction and vertical (Y-axis) direction, on the drawing plane. In this case, the light shielding properties in directions inclined at 45° to the X- and Y-axes are lower than those in the X- and Y-directions. The pattern shown in FIG. 4B and the pattern shown in FIG. 4C are different in the aperture ratio of the first regions 3, so that the settings of the transmittance of the entire light distribution control member 10 and the light shielding performance in the 45° direction are adjusted.

Figure 4D:
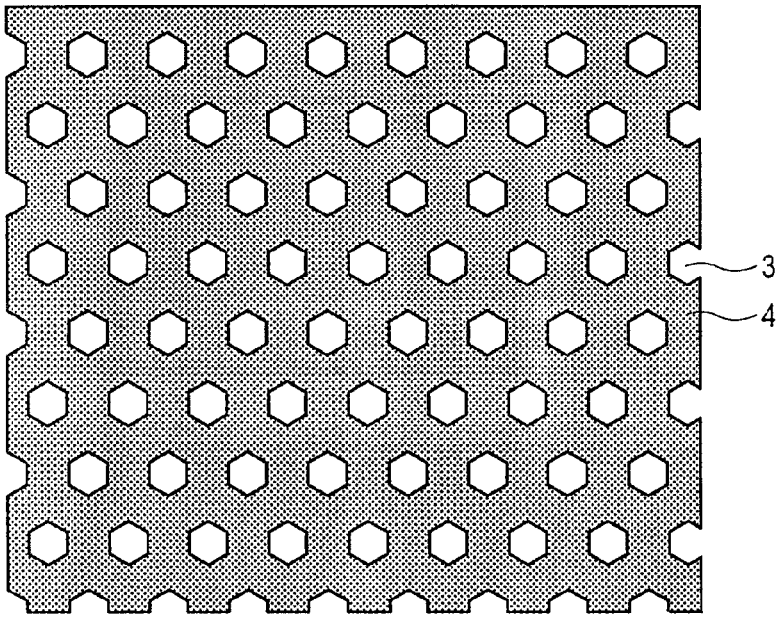
FIG. 4D is a plan view showing a pattern for the case where patterns of the first regions and second regions of the optical control layers are designed for light shielding in all directions.

FIG. 4D shows a pattern example that displays light shielding properties in all directions. While the light shielding performance is displayed in every direction, the aperture ratio in the first regions 3 is minimal, so that the transmittance of the entire light distribution control member 10 is also minimal.

Figure 4E:
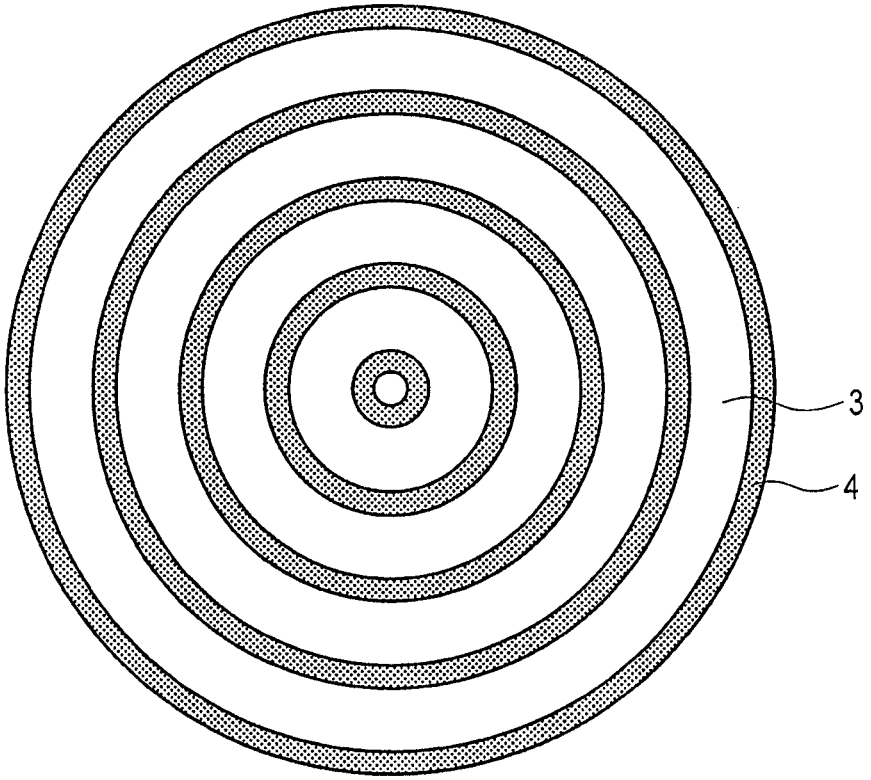
FIG. 4E is a plan view showing a pattern for the case where patterns of the first regions and second regions of the optical control layers are designed for radial light shielding for a point light source or light sources concentrated on a center.

FIG. 4E shows a pattern example of the light distribution control member 10 used for a point light source. In this case, the first and second regions 3 and 4 are formed in concentric circles around the point light source.

As described above, the patterns of the first and second regions 3 and 4 of the optical control layers 2*a* and 2*b* can be flexibly designed depending on the application. Further, the patterns can also be designed in accordance with the illuminance distribution of light incident on the light distribution control member 10.

Figure 4F:
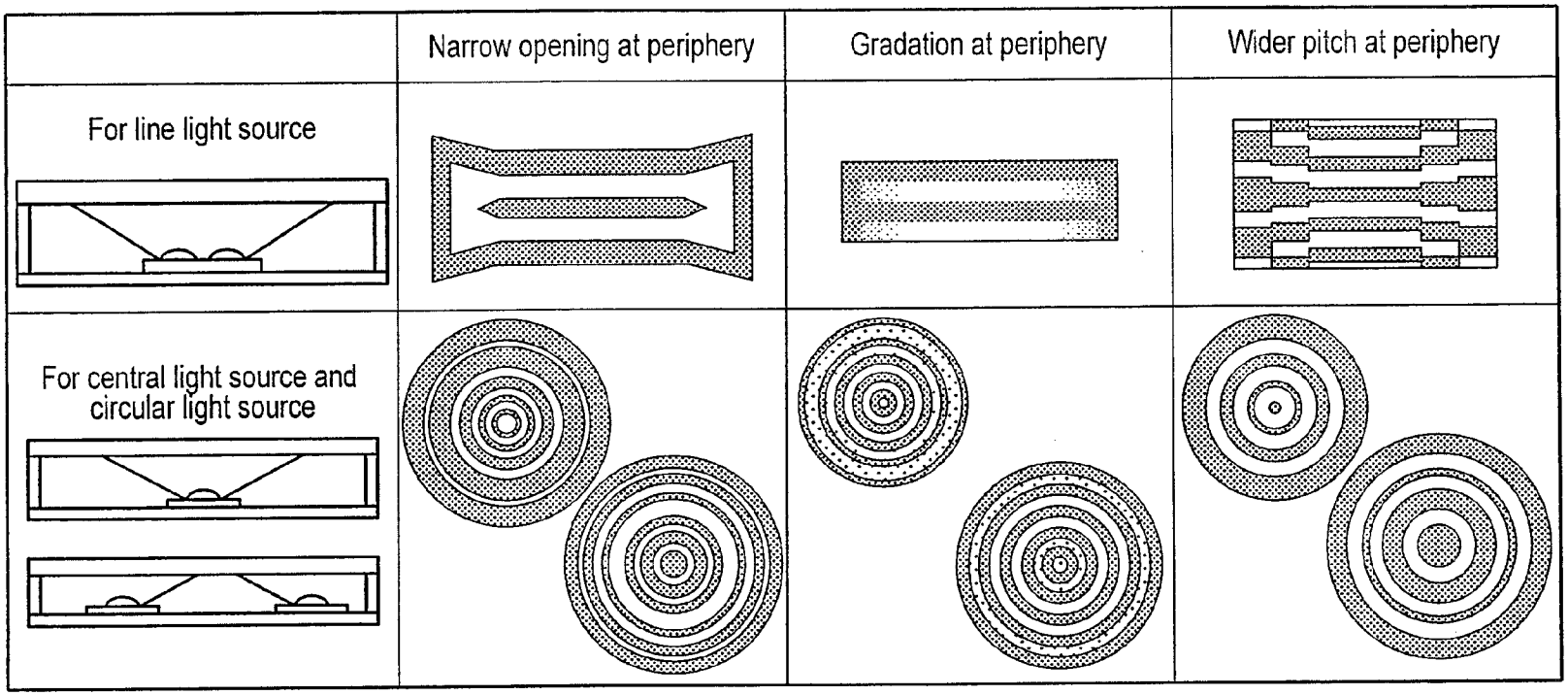
FIG. 4F is a diagram showing a plurality of pattern examples for the case where patterns of the first regions and second regions of the optical control layers are designed so as to adjust the aperture ratio to an illuminance distribution on a cover for a linear light source, central light source, or circular light source.

FIG. 4F shows design examples of the pattern of the light distribution control member given in consideration of the illuminance distribution of light, based on the configuration of the lighting device. The shown examples include an example in which the transverse pattern of the light distribution control member changes, based on a combination with a linear light source (line light source), and an example in which the radial pattern changes, based on a combination with a central light source, such as an LED bulb or light engine, or a circular light source. In that area of the light distribution control member 10 where the light illuminance distribution is small, the contribution amount of optical elements in the light shielding direction is also small. Accordingly, the efficiency of the lighting device can be improved, without degrading the effective light shielding amount of the entire light distribution control member 10 if possible, by increasing the aperture ratio of the first regions 3 in this area. Further, increasing the aperture ratio in the area where the illuminance distribution is low also contributes to equation of luminance in the entire light-emitting surface of the lighting device.

Figure 5:
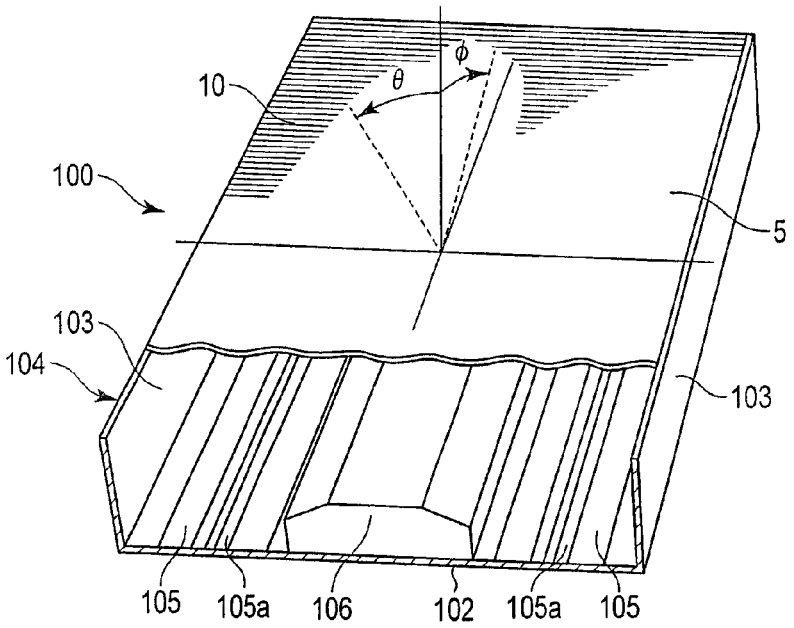
FIG. 5 is a perspective view showing a lighting device equipped with the light distribution control member according to the first embodiment.

FIG. 5 shows an example of the lighting device equipped with the illumination light distribution control member 10 described above.

This lighting device 100 comprises a housing 104 in the form of an elongated rectangular box. The housing 104 integrally comprises a rectangular bottom plate 102 and four sidewalls 103 set up along the peripheral edge of the bottom plate, and is formed as a processed steel product with a white reflective coating.

LED substrates 105 are arranged in two parallel rows on the inner surface of the bottom plate 102, and a power supply box 106 is disposed between these LED substrates 105. A plurality of LEDs 105*a* for use as light sources are mounted linearly side by side on each LED substrate 105. The LEDs 105*a* are arranged longitudinally relative to the bottom plate 102.

The light distribution control member 10 is set so as to close an opening of the housing 104, fixedly supported on the housing 104, and opposed to the LEDs 105*a* with a predetermined space therebetween. In the lighting device of the present embodiment, the light distribution control member 10 constitutes a planar light-emitting surface of the lighting device and is located opposite the light-emitting surface.

The light distribution control member 10 used may be an illumination light distribution control member according to the above-described embodiment or a modification. Optical control layers 2*a* and 2*b* of the light distribution control member 10 each comprise the first and second regions 3 and 4 in the form of stripes, and are disposed so that these stripes extend perpendicular to the direction of arrangement of the LEDs 105*a*.

Of light extracted from the lighting device 100 constructed in this manner, direct light emitted from the LEDs 105*a*, in the direction at vertical angle θ to the direction perpendicular to the rows of the LEDs 105*a*, is intercepted by the housing 104 and lateral portions of the power supply box 106 in a high-angle area. With respect to the direction at vertical angle ϕ to the direction parallel to the rows of the LEDs 105*a*, in contrast, means is needed to perform light distribution control for light emitted from the LEDs 105*a* arranged in a row throughout the area.

Let us suppose an example of the light distribution control member 10 used in the lighting device 100 and intended to suppress glare in an angular range of vertical angle ϕ of 70° or more. The base member 5 is made of a material used in a conventional lighting cover combined with transparent PMMA (acrylic resin) 2.0 mm thick. The refractive index n2 of PMMA is 1.49, which is higher than the refractive index n1 of ambient air of 1.0, so that the light distribution control member 10 can be designed.

To perform light distribution control in the direction of vertical angle ϕ, the patterns of the first and second regions 3 and 4 of the optical control layers 2*a* and 2*b* are formed to be stripe patterns shown in FIG. 4A, and are arranged perpendicular to the rows of the LEDs 105*a*. Based on the foregoing equation (2), α is 42.16°. Smin is 1.81 mm based on equation (1).

If γ is 70° according to equation (5), moreover, β is 39.1°, and S is 1.63 mm based on equation (4). Thus, light shielding at a vertical angle of incidence θ of 70° or more can be performed if opening width S of the first regions 3 is smaller than this value. Further, very stable characteristics can be obtained if print width W of the patterns of at least the one-side second regions 4 is set to be greater than a design value so that misalignment between opening patterns on either side of the base member 5 can be compensated for.

The second regions 4 of the optical control layers 2*a* and 2*b* that function as scattering reflection layers, scattering transmission layers, or light shielding layers can be formed directly on the base member 5 by screen printing as a simple method. In doing this, a light shielding effect can be obtained by black printing as the second regions 4, and a glare suppression effect based on diffuse reflection or diffuse transmission can be obtained by white or mat printing. An example of mat print is a print film containing fine particles of resin, such as PMMA or PS, and an inorganic dispersing agent, such as $SiO_2$ particles. An example of white print is a print film of an inorganic pigment, such as titanium oxide, barium sulfate, zinc oxide, or calcium carbonate.

Figure 6A:
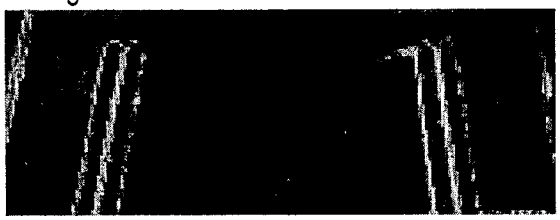
FIG. 6A is a two-dimensional graphic diagram of a luminance distribution of a lighting device without a light distribution control member, measured from a distance at a light distribution angle $\phi$ of 70°.
Figure 6B:
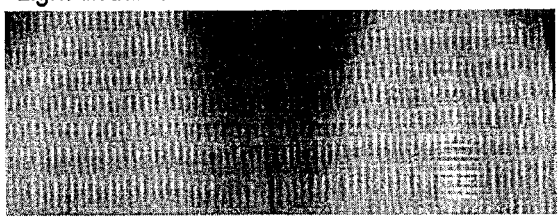
FIG. 6B is a two-dimensional graphic diagram of a luminance distribution of the lighting device according to the first embodiment, measured from a distance at a light distribution angle $\phi$ of 70°.

FIG. 6A shows a luminance distribution of a lighting device incorporated with only a transparent cover without comprising a light distribution control member. As seen from this drawing, the luminance of only a light source section is extremely high. On the other hand, FIG. 6B is a two-dimensional graph of a luminance distribution measured from a distance at a light distribution angle ϕ of 70°, showing the luminance distribution of the above-described lighting device 100. A comparison between FIGS. 6A and 6B reveals that, in the lighting device 100 comprising the light distribution control member 10, the luminance on the light source is reduced and those in other regions than on the light source are increased, so that the luminance distribution of the entire cover surface is uniform.

Figure 7:
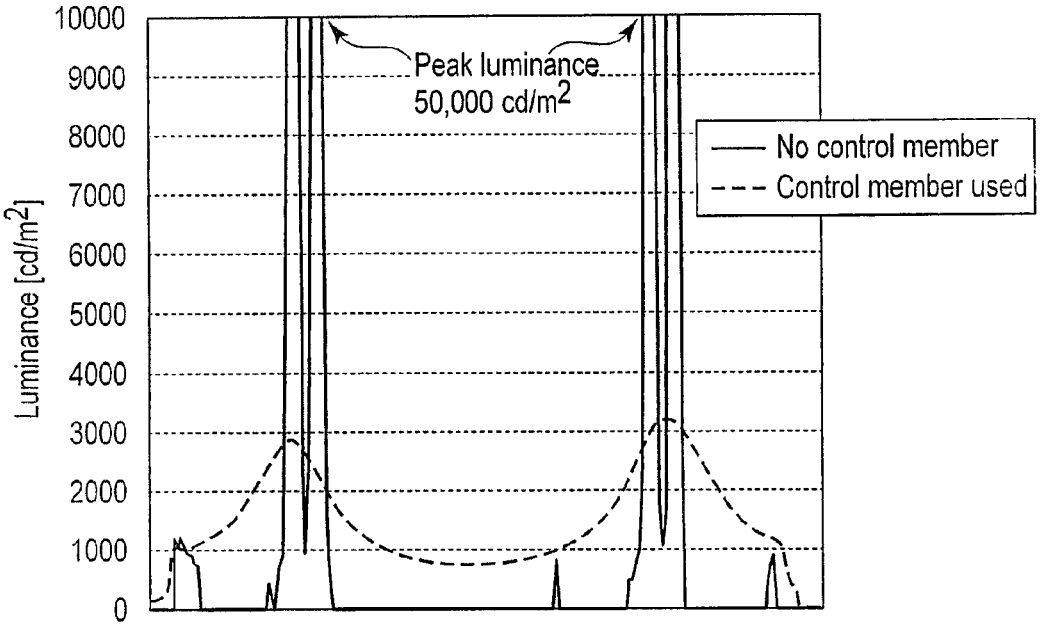
FIG. 7 is a diagram showing a luminance profile perpendicular to the light source in the luminance distributions shown in FIGS. 6A and 6B.

FIG. 7 is a graph showing a luminance profile perpendicular to the LEDs 105*a* in the luminance distributions shown in FIGS. 6A and 6B. The displayed example uses an illumination light distribution control member in which a mat print film with a total light transmittance of about 90% is disposed in a stripe pattern. The use of this illumination light distribution control member leads to a reduction of the peak luminance of the light source by about 94%, thus displaying a high glare suppression effect.

According to the configuration described above, there can be obtained a ceiling lighting device with a high vertical illuminance, free from glare when viewed obliquely from a distance while maintaining high light-extraction efficiency.

Figure 9A:
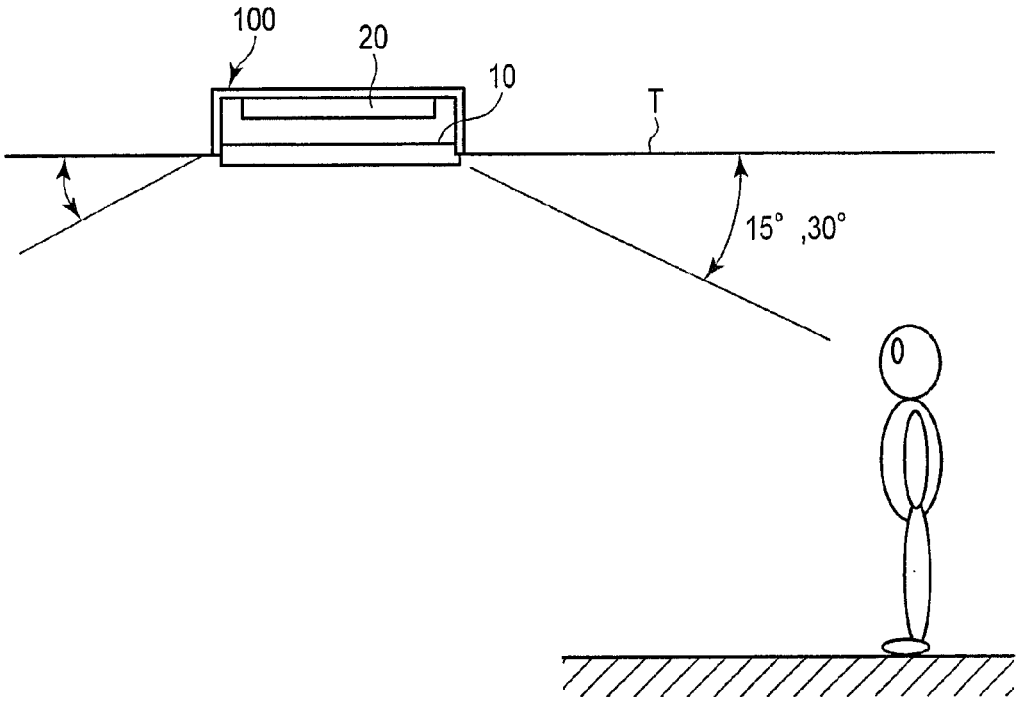
FIG. 9A is a perspective view showing an installation example of the lighting device according to the first embodiment.

FIG. 9A shows an example in which the above-described illumination light distribution control member 10 is mounted parallel to a ceiling T in a light-emitting area of the lighting device 100. Generally, an angle of 15 or 30° is used as a light shielding angle for suppressing an unpleasant glare. Since the light distribution control member 10 of this configuration is incorporated in the lighting device 100, however, the illuminance just below the lighting device 100 can be secured to reduce glare perceived when the lighting device is viewed obliquely.

Since the light distribution is controlled by means of the interference effect of the two optical control layers 2*a* and 2*b* according to the present embodiment, moreover, the control is irrespective of the position and direction of the light incident on the light distribution control member 10. Since the light distribution control can be performed irrespective of the position and orientation of the light source, a simple fixing structure can be employed without regard to misalignment of the light distribution control member 10 relative to the light source 20. Since the light distribution control member 10 comprises the base member 5 and the optical control layers 2*a* and 2*b* formed by pattern printing on its opposite surfaces, the light distribution control member 10 can be cleaned by only wiping its outer surface, so that its maintenance is easy.

In the lighting device, furthermore, the light source is not limited to a row or rows of LEDs, and may alternatively be a straight-tube fluorescent lamp, light-emitting elements arranged in dots, etc. The housing is not limited to the rectangular shape and various shapes are selectable.

The following is a description of lighting devices according to alternative embodiments. In the description of the alternative embodiments to follow, like reference numbers are used to designate the same portions as those of the foregoing first embodiment, and a detailed description thereof is omitted.

Second Embodiment

Figure 8A:
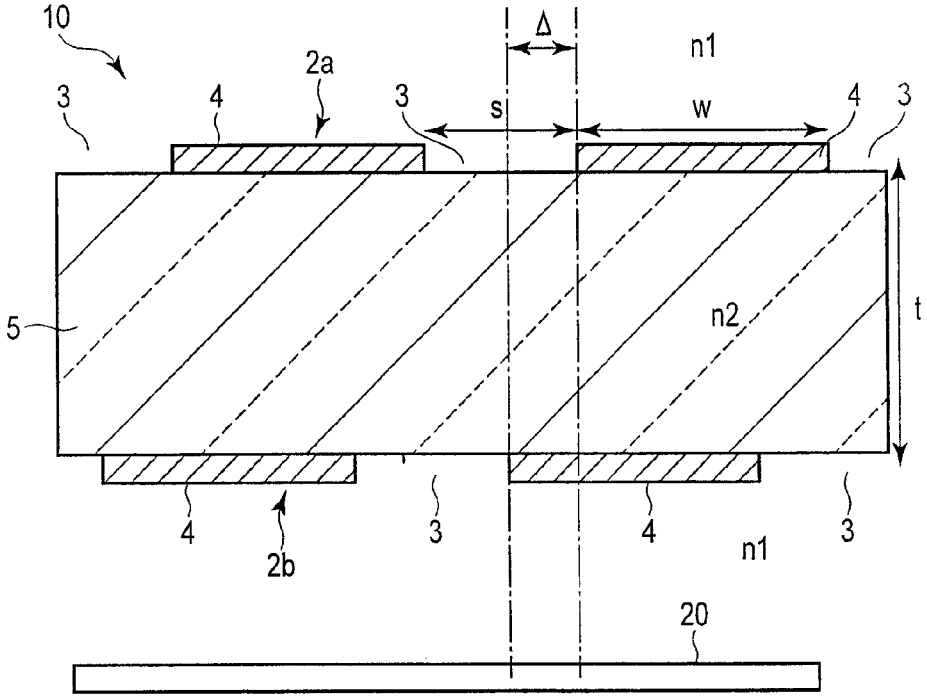
FIG. 8A is a sectional view schematically showing an illumination light distribution control member used in a lighting device according to a second embodiment.

FIG. 8A is a sectional view of an illumination light distribution control member 10 used in a lighting device according to a second embodiment. Basically, the configuration of the light distribution control member 10 is the same as that of the first embodiment shown in FIG. 1A, so that the following description is focused on different portions.

As shown in FIG. 8A, the illumination light distribution control member 10 comprises a 1-mm-thick base member 5 made of a transparent resin with a refractive index of, for example, 1.49, and optical control layers 2*a* and 2*b* formed individually on the opposite surfaces of the base member 5. Each of the optical control layers 2*a* and 2*b* is configured so that a plurality of striped light-scattering films are formed by printing on a surface of the base member 5. In each of the optical control layers 2*a* and 2*b*, first regions 3 of width S as non-printed portions and second regions 4 of width W as printed portions are alternately arranged side by side in the transverse direction of the stripes.

The respective patterns of the two optical control layers 2*a* and 2*b* are somewhat shifted in phase Δ in the transverse direction of the stripes, and light is transmitted through the second regions 4 having scattering transmission properties outside the range of vertical angle of incidence of −30 to 60°.

Among light beams incident on the light distribution control member 10 at vertical angle of incidence θ, as shown in FIG. 8A, a light beam in the normal direction at an angle θ of zero is applied to the second regions 4 of the optical control layers 2*a* and 2*b* and diffuse-reflected toward a light source 20 by a reflective coating. A light beam incident at a predetermined oblique angle of incidence θ is directly passed through the first regions 3 of the optical control layers 2*a* and 2*b* and emitted to the outside.

Figure 8B:
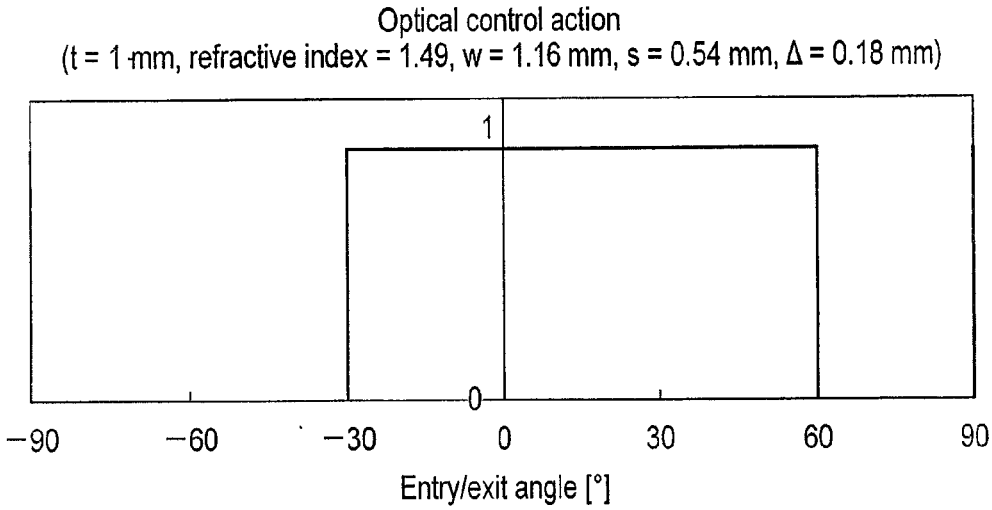
FIG. 8B is a diagram showing the relationship between the entry/exit angle of light passing through the light distribution control member and the presence/absence of an optical control action.

The abscissa of FIG. 8B represents vertical entry/exit angle θ of a light beam to the light distribution control member 10, and the ordinate represents the presence/absence of light that slips through the second regions 4 of the light distribution control member 10 (1 indicates the presence of light that slips through an optical control region, and 0 indicates that all light strikes the optical control region). In the second embodiment, the light distribution control member 10 is designed to diffuse-reflect the light beam in the range of vertical angle of incidence θ of ±30° and directly transmit the light beam in the range of vertical angle of incidence θ of 30 to 60°. Thus, functions are displayed to suppress light emission in the direction normal to the light distribution control member 10 and emit light obliquely at a vertical angle of incidence of 30 to 58°.

Figure 9B:
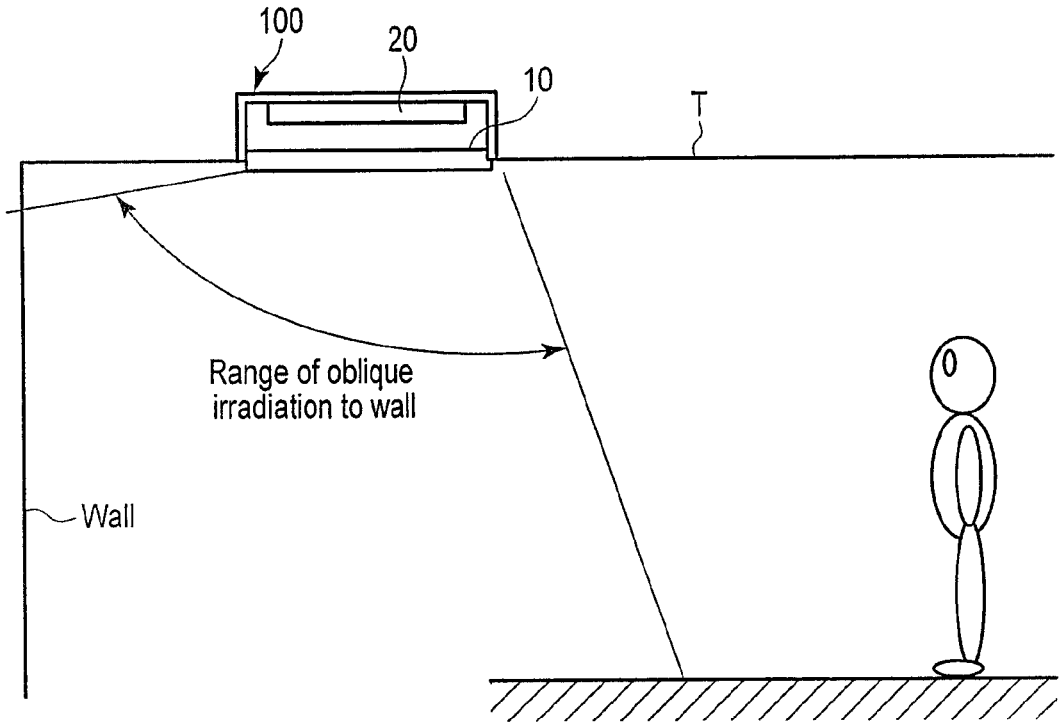
FIG. 9B is a perspective view showing an installation example of the lighting device according to the second embodiment.

FIG. 9B shows an example in which the light distribution control member 10 of this type is installed in a light-emitting area of a lighting device 100 on a wall surface of a room. By thus incorporating the existing lighting device 100 with the light distribution control member 10 that distributes light in a specific direction, illumination for applying light to a ceiling or floor can be easily obtained without making the wall surface dazzling. The second embodiment differs from the first embodiment in that the two optical control layers 2*a* and 2*b* are shifted in phase.

Third Embodiment

In an illumination light distribution control member 10, a base member 5 and optical control layers 2*a* and 2*b* may be provided separately. The light distribution control member 10 and a lighting device may be configured so that light distribution control can be dynamically performed by making phase Δ or space t of the optical control layers 2*a* and 2*b* variable.

Figure 10A:
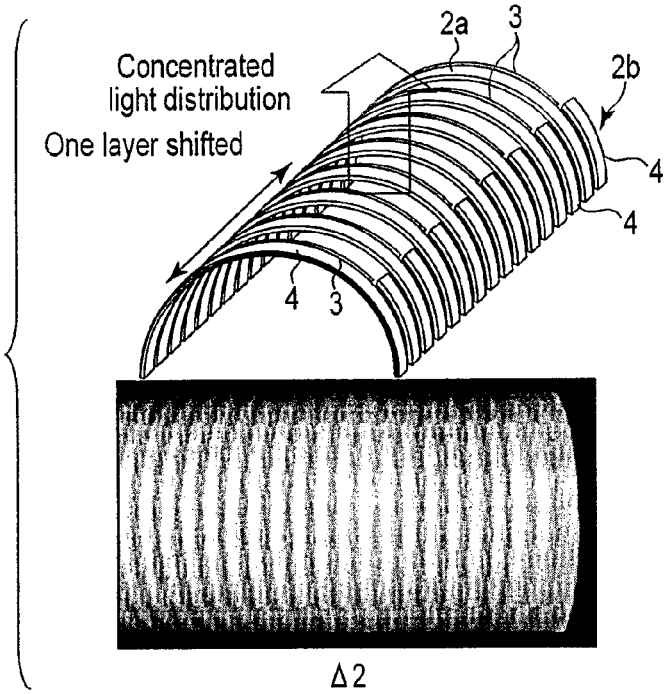
FIG. 10A is a conceptual diagram schematically showing an illumination light distribution control member used in a lighting device according to a third embodiment.
Figure 10B:
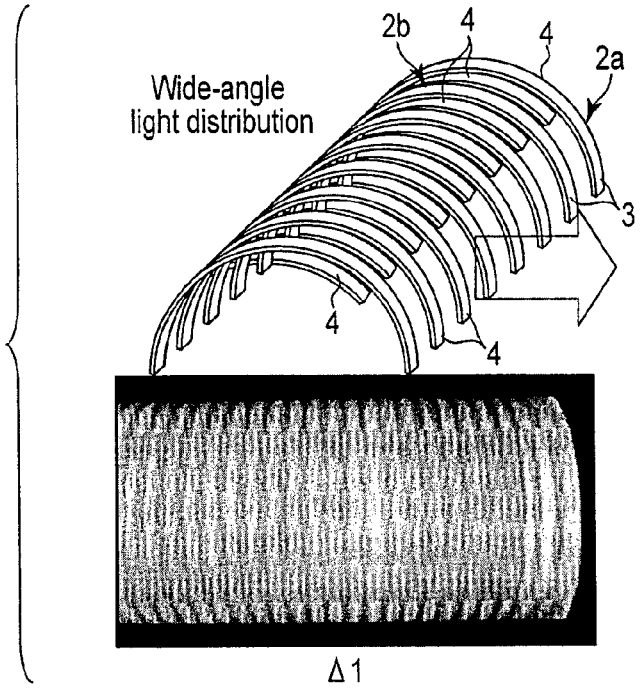
FIG. 10B is a conceptual diagram schematically showing another illumination light distribution control member used in the lighting device according to the third embodiment.

FIGS. 10A and 10B show the lighting device with the light distribution control member 10 according to a third embodiment. The light distribution control member 10 with a main function is incorporated in a cover of the lighting device of a fluorescent-lamp type. Optical control layers 2*a* and 2*b* are printed individually on separate bendable sheets, and the base member 5 is sandwiched between them. Phases Δ of the optical control layers 2*a* and 2*b* can be manually varied. Optical control layer 2*a* is in an ordinary stripe pattern, while the optical control layer 2*b* is in a stripe pattern obtained by shifting its frontal and lateral phases.

If phases Δ of the optical control layers 2*a* and 2*b* are moved in this configuration, the patterns of the optical control layers 2*a* and 2*b* laterally overlap each other and patterns in the frontal direction are covered by their respective second regions 4 in one phase Δ1, as shown in FIG. 10A. In another phase Δ2, as shown in FIG. 10B, the patterns of the optical control layers 2*a* and 2*b* overlap each other in the frontal direction area patterns in the lateral direction are covered by their respective second regions 4.

The lighting device incorporated with the light distribution control member 10 constructed in this manner is a lighting device in which the respective light distributions of frontal concentrated light and lateral wide-angle light are manually switched.

Fourth Embodiment

Figure 11A:
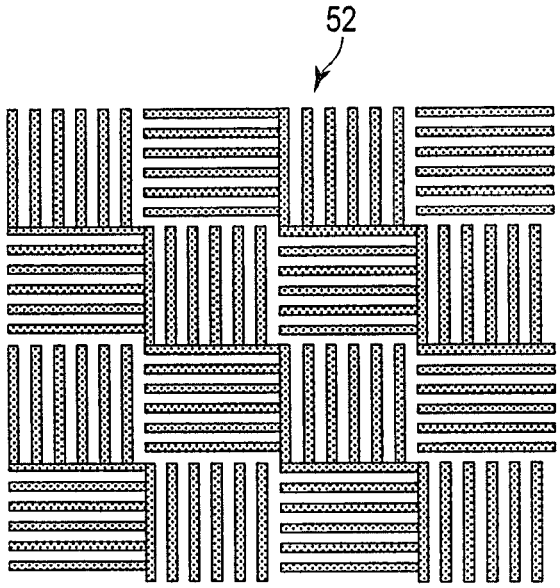
FIG. 11A is a conceptual diagram schematically showing an illumination light distribution control member used in a lighting device according to a fourth embodiment.
Figure 11B:
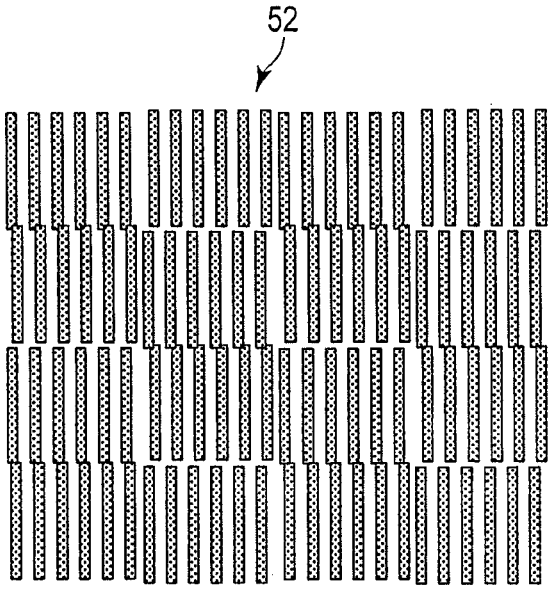
FIG. 11B is a conceptual diagram schematically showing the illumination light distribution control member used in the lighting device according to the fourth embodiment.
Figure 11C:
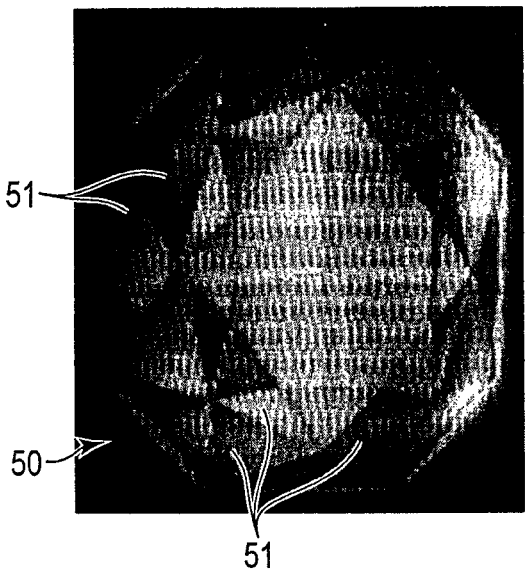
FIG. 11C is a conceptual diagram schematically showing the illumination light distribution control member used in the lighting device according to the fourth embodiment.
Figure 11D:
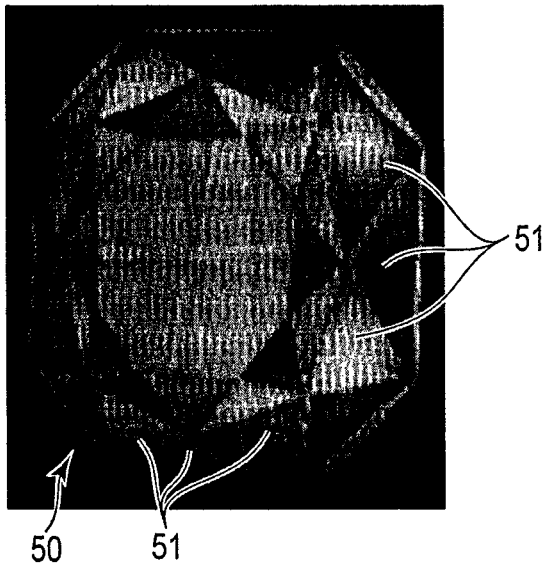
FIG. 11D is a conceptual diagram schematically showing the illumination light distribution control member used in the lighting device according to the third embodiment.

An illumination light distribution control member 10 may comprise a three-dimensional base member 5. FIGS. 11A to 11D show a lighting device according to a fourth embodiment, in which the light distribution control member 10 with a main function is incorporated in a three-dimensionally shaped cover that covers a light source. As shown in FIGS. 11C and 11D, a three-dimensionally shaped cover 50 is shaped so as to have a plurality of faceted surfaces 51 with different normal directions. As shown in FIGS. 11A and 11B, optical control layers of stripe patterns 52 with different phases and orientations are assigned individually to the faceted surfaces 51 of the three-dimensionally shaped cover 50. Thereupon, the light distribution varies with every region, so that the faceted surfaces individually change their brightness depending on the viewing position. Thus, the lighting cover can be given a novel decorative effect. The three-dimensional cover can be manufactured by printing a print film corresponding to a forming process on a forming substrate and performing an existing thermoforming process (vacuum forming, air-pressure forming, etc.).

According to the various embodiments described in detail above, there can be provided an illumination light distribution control member, capable of being easily cleaned without being affected by the arrangement or specification of a light source, low in manufacturing cost, and high in light-extraction efficiency and light distribution controllability, and a lighting device provided with the same.

The present invention is not limited directly to the embodiments described above, and at the stage of carrying out the invention, its constituent elements may be embodied in modified forms without departing from the spirit of the invention.

Further, various inventions can be formed by appropriately combining the constituent elements disclosed in the above-described embodiments. For example, some constituent elements may be deleted from all the constituent elements shown in the embodiments. Furthermore, constituent elements of different embodiments may be combined as required. In the illumination light distribution control member, the optical control layers are not limited to two in number and may be three or more.

What is claimed is:

1. A lighting device comprising:

a light source; and at least one light distribution control member configured to control distribution of light from the light source, the light distribution control member comprising a base member higher in refractive index than air, and two optical control layers located opposite each other with a predetermined space therebetween on either side of the base member, the two optical control layers each comprising a first region and a second region formed in correlative patterns, the light distribution control member being configured to control the light distribution based on a change of an overlap between the first and second regions depending on a direction of transmitted light, wherein a width of the second region of at least one of the optical control layers is smaller than S defined as follows:

$$S=t\times\tan(\beta),$$

$$\text{where } \beta=\arcsin\{(n1/n2)\cdot\sin(\gamma)\},$$

$$-75°\leq\gamma\leq75°,$$

where β is an angle of light in the base member, n1 and n2 are indexes of refraction of air and the base member, and t is thickness of the base member.

2. The lighting device of claim 1, wherein a transmittance of the second region is lower than a transmittance of the first region.

3. The lighting device of claim 2, wherein a light distribution of light transmitted through the second region is spread wider than a light distribution of light transmitted through the first region.

4. The lighting device of claim 1, wherein a width of the first region of at least one of the optical control layers is greater than Wmin defined as follows:

$$W\text{min}=t\times\tan(\alpha),$$

$$\text{Where } \alpha=\arcsin(n1/n2),$$

where α is an incident angle of light, n1 and n2 are indexes of refraction of air and the base member, and t is thickness of the base member.

5. The lighting device of claim 1, wherein the first and second regions of one of the optical control layers are deviated from the first and second regions of the other optical control layer by a predetermined phase in a direction normal to the optical control layers.

6. The lighting device of claim 1, wherein the light source comprises a light-emitting area extending in a single direction and the patterns of the first and second regions are in a shape of stripes perpendicular to the extending direction of the light source.

7. The lighting device of claim 1, wherein the light source comprises a punctiform light-emitting area and the patterns of the first and second regions are in a shape of concentric circles around the light-emitting area of the light source.

8. The lighting device of claim 1, wherein the pattern of the second region is arranged discretely and two-dimensionally.

9. The lighting device of claim 1, wherein at least one of the two optical control layers is movable relative to the base member, and the two optical control layers are displaceable relative to each other and are configured to control the light distribution by displacing the two optical control layers.

10. The lighting device of claim 1, wherein the pattern of the first region and the pattern of the second region include a plural patterns with different phases and orientations.

11. A lighting device comprising:

a light source; and at least one light distribution control member configured to control distribution of light from the light source, the light distribution control member comprising a base member higher in refractive index than air, and two optical control layers located opposite each other with a predetermined space therebetween on either side of the base member, the two optical control layers each comprising a first region and a second region formed in correlative patterns, the light distribution control member being configured to control the light distribution based on a change of an overlap between the first and second regions depending on a direction of transmitted light, wherein a width of the first region of at least one of the optical control layers is greater than Wmin defined as follows:

$$W\text{min}=t\times\tan(\alpha),$$

$$\text{Where } \alpha=\arcsin(n1/n2),$$

where α is an incident angle of light, n1 and n2 are indexes of refraction of air and the base member, and t is thickness of the base member.

12. The lighting device of claim 11, wherein a transmittance of the second region is lower than a transmittance of the first region.

13. The lighting device of claim 12, wherein a light distribution of light transmitted through the second region is spread wider than a light distribution of light transmitted through the first region.

14. The lighting device of claim 11, wherein the first and second regions of one of the optical control layers are deviated from the first and second regions of the other optical control layer by a predetermined phase in a direction normal to the optical control layers.

15. The lighting device of claim 11, wherein the light source comprises a light-emitting area extending in a single direction and the patterns of the first and second regions are in a shape of stripes perpendicular to the extending direction of the light source.

16. The lighting device of claim 11, wherein the light source comprises a punctiform light-emitting area and the patterns of the first and second regions are in a shape of concentric circles around the light-emitting area of the light source.

17. The lighting device of claim 11, wherein the pattern of the second region is arranged discretely and two-dimensionally.

* * * * *